United States Patent [19]

Tene

[11] Patent Number: 4,827,688

[45] Date of Patent: May 9, 1989

[54] TRUSS STRUCTURE

[76] Inventor: Yair Tene, 4 Mapu Boulevard, Haifa 34 361, Israel

[21] Appl. No.: 145,159

[22] Filed: Jan. 19, 1988

[51] Int. Cl.[4] ..... E04C 3/30

[52] U.S. Cl. ..... 52/694; 52/648; 52/696; 52/732

[58] Field of Search ..... 52/648, 690, 693, 694, 52/729, 730, 732, 738, 696

[56] References Cited

U.S. PATENT DOCUMENTS

| | | | |
|---|---|---|---|
| 1,911,018 | 5/1933 | Goeltz | 52/648 |
| 2,089,023 | 8/1937 | Hahn | 52/694 |
| 2,114,901 | 4/1938 | Henderson | 52/732 X |
| 4,461,134 | 7/1984 | Lowe | 52/732 |

FOREIGN PATENT DOCUMENTS

| | | | |
|---|---|---|---|
| 393823 | 11/1908 | France | 52/694 |
| 129723 | 7/1919 | United Kingdom | 52/696 |

*Primary Examiner*—David A. Scherbel
*Assistant Examiner*—Richard E. Chilcot, Jr.
*Attorney, Agent, or Firm*—Bejamin J. Barish

[57] ABSTRACT

A truss comprises a pair of spaced, longitudinally-extending bars (or only one such bar), and a plurality of transversely-extending, or diagonal, bars occupying a common plane. One longitudinally-extending bar is disposed in a plane laterally spaced from the common plane on one side thereof, and the other logitudinally-extending bar (when included) is disposed in a plane laterally spaced from the common plane on the opposite side thereof. Such a structure permits a plurality of the trusses to be stored or transported in nesting relationship in order to occupy a minimum volume, and also permits each truss to serve as a modular element enabling any desired number of them to be secured together in building a structural framework of the desired configuration and strength.

19 Claims, 3 Drawing Sheets

FIG 3
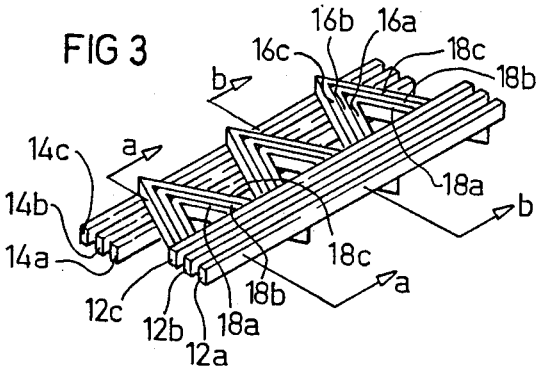
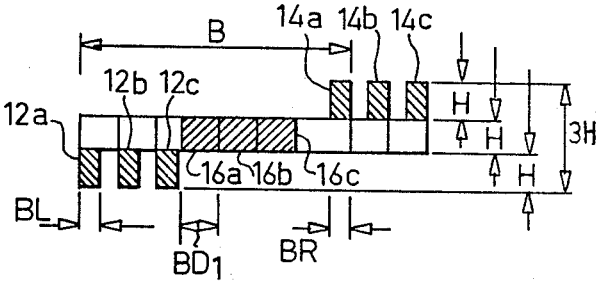
FIG 3a
FIG 3b
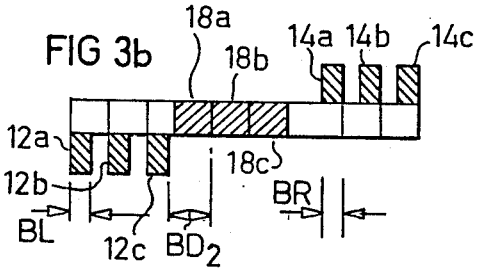
FIG 4
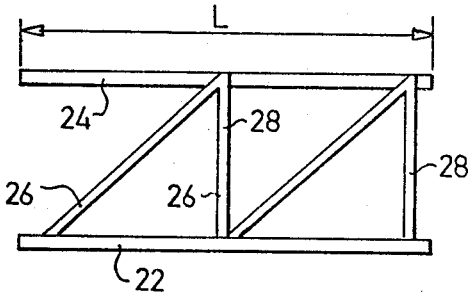
FIG 5
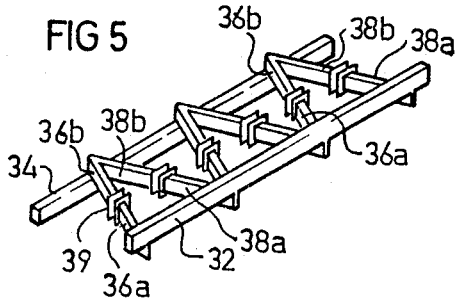

FIG 6
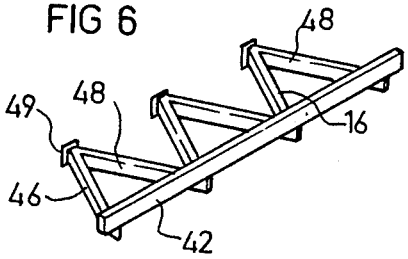
FIG 6a
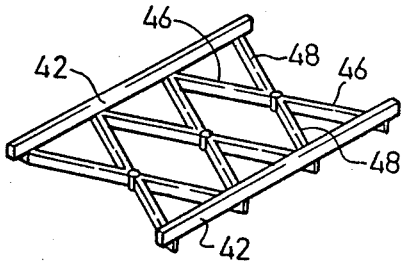
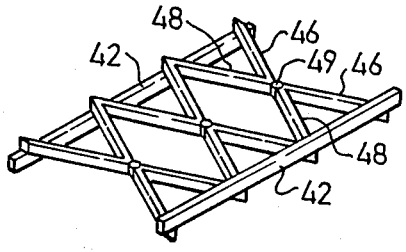
FIG 6b
FIG 7
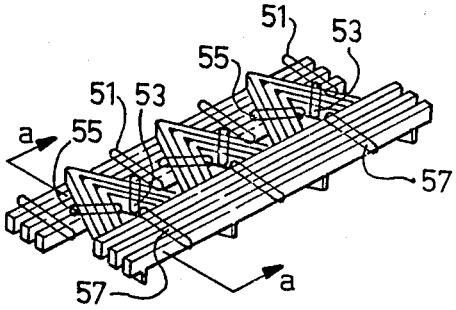
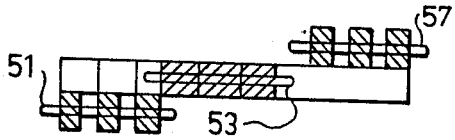
FIG 7a

TRUSS STRUCTURE

BACKGROUND OF THE INVENTION

The present invention relates to truss structures, such as are used in the building industry as supporting elements for floors, roofs, platforms, bridge decks, columns and walls, and for building various prefabricated constructions, e.g., bridges, scaffolding, ladders, storage structures, electric poles, and antenna structures, and the like. Trusses are used also as part of marine structures including ships rafts and oil drilling platforms, in vehicles, aircraft, and space industries for various structural elements. Of special interest are constructions to be used for building large structures in outer space, on the moon, or other planets.

The conventional truss comprises a pair of spaced, usually but not necessarily parallel, longitudinally-extending bars, and a plurality of transversely-extending, or diagonal, bars joined at longitudinally-spaced points to the pair of longitudinally-extending bars. In the conventional truss structure, all of the above bars occupy the same plane. The truss structure may be made of any suitable material, such as steel, wood, plastic, or concrete.

BRIEF SUMMARY OF THE PRESENT INVENTION

An object of the present invention is to provide a novel truss structure having a number of important advantages, as will be described more particularly below.

According to the present invention, there is provided a truss structure comprising a first, single longitudinally-extending bar extending along one side of the truss, a second, single longitudinally-extending bar extending along the opposite side of the truss, and a plurality of transversely-extending bars joined at longitudinally-spaced points to the first and second longitudinally-extending bars to occupy a first plane. The first longitudinally-extending bar is disposed in a second plane laterally spaced from the first plane on one side of the transversely-extending bars, and the second longitudinally-extending bar is disposed in a third plane laterally spaced from the first plane on the other side of the transversely-extending bars. The transversely-extending bars are disposed in a repeating pattern with tapered spaces inbetween, such as to permit a plurality of such trusses to be nested together with the transversely-extending bars of all the trusses disposed in the mentioned first plane, and the longitudinally-extending bars of all the trusses disposed in the mentioned second and third planes, respectively.

Such a truss provides a number of important advantages. Thus, it permits a plurality of such trusses to be nested together to occupy a minimum volume for storage or transportation. It also permits such structures to serve as modular elements for constructing a truss structure or framework of any desired strength by securing together a plurality of such trusses in any desired geometrical combination, including a nesting relationship.

The invention also contemplates that each truss may be constructed in the form of two sections, each of which may be transported or stored in nesting relationship in order to occupy a minimum volume, and to be secured together to form the conventional truss structure or framework at the construction site.

Accordingly, the invention also provides a structural member particularly useful for constructing a truss framework, the structural member comprising a longitudinally-extending bar, and a plurality of transversely-extending bars joined at longitudinally-spaced points to the longitudinally-extending bar. The transversely-extending bars are all joined at one of their ends to the longitudinally-extending bar to occupy a first plane, which plane is laterally of a second plane containing the longitudinally-extending bar. The opposite ends of the transversely-extending bars are formed with attaching flanges for constructing a truss by attaching two such structural members together. As in the previously-described truss, the transversely-extending bars are disposed in a repeating pattern with tapered spaces inbetween, such as to permit a plurality of such structural members to be nested together with the transversely-extending bars of all the structural members disposed in the first plane, and the longitudinally-extending bars of all the structural members disposed in the second plane.

The foregoing novel structural elements may be used to construct any of the conventional truss structures, including, but not limited to, those in which the transversely-extending bars are all diagonal members defining isosceles triangles, or are both diagonal and perpendicular members defining right-angle triangles. In addition they may be used not only for conventional structure, but also in toys or erection sets where compactness for storage or shipping is usually of at least equal importance as mechanical strength.

BRIEF DESCRIPTION OF THE DRAWINGS

The invention will be better understood by reference to the accompanying drawings, wherein:

FIG. 3 illustrates a plurality of the trusses of FIG. 2 assembled together in nesting relationship for transportation or storage, FIGS. 3*a* and 3*b* being sectional veiws along line a—a and b—b, respectively, of FIG. 3;

FIG. 4 is a side-elevational view illustrating another truss constructed in accordance with the present invention;

FIG. 5 is a perspective view illustrating a two-section truss constructed in accordance with the present invention;

FIG. 6 is a perspective view illustrating one section of another type of 2-section truss, FIGS. 6*a* and 6*b* showing two possible truss constructions using two of the sections of FIG. 6; and FIG. 7 illustrates a plurality of the trusses of FIG. 2 used as modular elements and assembled together in nesting relationship to produce a truss framework of any desired strength according to the particular application, FIG. 7*a* being a section along line a-aa of FIG. 7.

TRUSS STRUCTURE OF THE PRIOR ART

Figure 1:
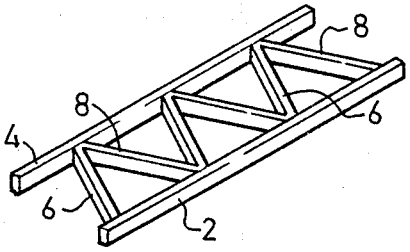
FIG 1 (PRIOR ART)
FIG. 1 illustrates a conventional truss in accordance with the prior art, FIG. 1*a* being a side elevational view of FIG. 1, and FIG. 1*b* being a section along line b—b of FIG. 1*a;*
Figure 1A:
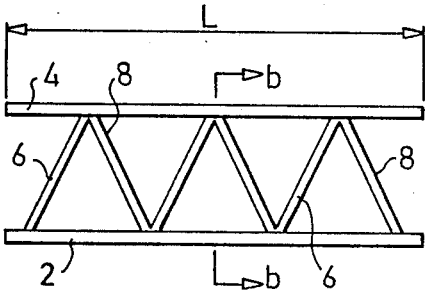
FIG 1a (PRIOR ART)
Figure 1B:
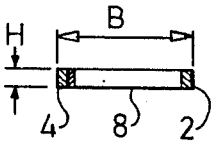
FIG 1b (PRIOR ART)

One common form of truss in accordance with the prior art is illustrated in FIGS. 1, 1*a* and 1*b*. Such a truss includes a pair of longitudinally-extending elements or bars 2, 4, in parallel, spaced relationship and joined together by a plurality of transversely-extending bars 6, 8. In the truss illustrated in FIGS. 1, 1*a* and 1*b*, the transversely-extending bars 6, 8 extend diagonally between the two longitudinally-extending bars 2, 4, and define a plurality of isosceles triangles therewith. It will be appreciated, however, that the known truss structures include other configurations forming non-isosceles triangles, e.g., wherein one transversely-extending bar (6, 8) is longer than the other, or extends perpendicularly between the two longitudinally-extending bars 2, 4. The present invention may also be embodied in such other known truss structures.

In the conventional truss as illustrated in FIGS. 1, 1*a* and 1*b*, the volume (v) occupied by the truss is the product of its length (L), its width (B) and its height (H), as shown particularly in FIGS. 1*a* and 1*b*. Accordingly, the volume of a plurality of such trusses would be the volume of each truss multiplied by the number of such trusses. The volume required for storing or shipping a plurality of such trusses is therefore relatively large, since it includes a relatively high proportion of empty space, namely the space between the transversely-extending bars.

DESCRIPTION OF PREFERRED EMBODIMENTS OF THE INVENTION

The invention of the present application provides a novel truss structure which permits the trusses to be stored or shipped in nesting relationship so as to occupy a substantially smaller volume. The present invention also enables such trusses to be used as modular elements to be assembled and secured in nesting relationship in order to produce a truss framework of any desired strength according to the particular application.

Figure 2:
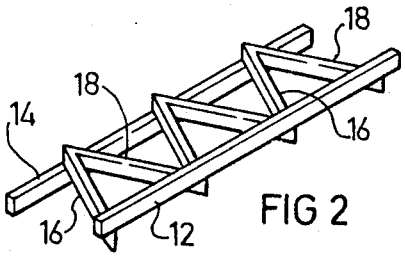
FIG. 2 illustrates one form of truss in accordance with the present invention, FIG. 2*a* being a side elevational view of the truss of FIG. 2, and FIG. 2*b* being a section along line b—b of FIG. 2*a;*
Figure 2A:
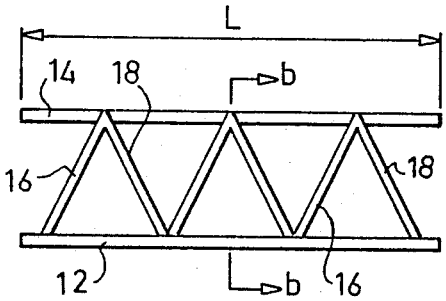
Figure 2B:
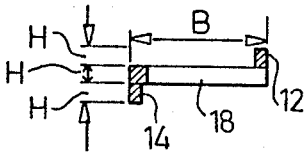

One form of truss constructed in accordance with the present invention is illustrated in FIG. 2, and its associated FIGS. 2*a* and 2*b*. The truss illustrated in these figures comprises the same basic elements as the truss structure in FIG. 1, namely a pair of longitudinally-extending bars 12, 14, in parallel, spaced relationship, and a plurality of transversely-extending bars 16, 18 joined at longitudinally-spaced points to the bars 12, 14.

As distinguished from the known truss illustrated in FIG. 1, however, in the truss illustrated in FIG. 2 all the bars 12, 14, 16 and 18 are not in a common plane. Rather, the transversely-extending bars 16, 18 are in one common plane, but the longitudinally-extending bar 12 is in a second plane laterally spaced from the plane of bars 16, 18 on one side thereof, and the longitudinally-extending bar 14 is in a third plane laterally spaced from the plane of bars 16, 18 on the opposite side thereof. This is shown more particularly in FIG. 2*b*.

FIGS. 3, 3*a* and 3*b* illustrate how a plurality of the trusses of FIG. 2 may be assembled together in nesting relationship in order to occupy a minimum volume for shipment or storage. For purposes of example, three such trusses are illustrated, but it will be appreciated that this number could be only two, or could be four or more. Actually, the larger the number of trusses assembled in the illustrated nesting relationship, the greater the saving of space in shipping or storing such trusses.

More particularly, illustrated in FIGS. 3, 3*a* and 3*b* are: a first truss constituted of longitudinally-extending bars 12*a*, 14*a* and diagonal bars 16*a*, 18*a*; a second truss constituted of longitudinally-extending bars 12*b*, 14*b* and diagonal bars 16*b*, 18*b*; and a third truss constituted of longitudinally-extending bars 12*c*, 14*c* and diagonal bars 16*c*, 18*c*. In this example, all of these bars have the same height (H), whereas they have different thicknesses of section in the direction of stacking. Thus, the longitudinally-extending bars 12*a*, 12*b*, 12*c* have one section-thickness (BL); the longitudinally-extending bars 14*a*, 14*b*, 14*c* have a second section-thickness (BR), which may be the same as BL; the diagonal bars 16*a*, 16*b*, 16*c* have a third section-thickness ($BD_1$); and the diagonal bars 18*a*, 18*b*, 18*c* have a fourth section-thickness ($BD_2$). The distance between the stacked trusses in the stacking direction is determined by the largest of the section thicknesses BR, BL, $BD_1$, $BD_2$.

It will be thus seen that the volume occupied by the plurality of nested trusses illustrated in FIGS. 3, 3*a* and 3*b*, for large numbers of stacked trusses, is substantially smaller than the volume that would be required for the same trusses of the prior art construction as illustrated in FIG. 1. It will also be seen that where the section-thickness ($BD_1$ or $BD_2$) of the diagonal bars 16*a*–16*c*, 18*a*–18*c* is larger than that (BL, BR) of the longitudinally-extending bars 12*a*–12*c* and 14*a*–14*c*, as illustrated in FIG. 3*a*, there is some wasted space between the longitudinally-extending bars, but this space too can be saved, thereby further minimizing the total volume, by making all the bars of equal section-thickness.

The novel truss illustrated in FIGS. 2 and 3 is of the isosceles triangle type, wherein the diagonal bars 16, 18 are of equal length and form equal-sided triangles between the longitudinally-extending bars 12, 14. In such a construction, bars 16 constitute a first plurality of the transversely-extending bars joined to the longitudinally-extending bars 12, 14 at a first angle, which angle is equal to the angle formed by the second group of transversely-extending bars 18 with resepct to a line (not shown) extending perpendicularly between the longitudinally-extending bars 12, 14, but on opposite sides of such line.

FIG. 4 illustrates the invention embodied in a truss construction wherein the transversely-extending bars, therein designated 26, 28, define right-angle triangles between the longitudinally-extending bars 22, 24. Thus, the transversely-extending bars 26 form a first group defining the same angle between the longitudinally-extending bars 22, 24, whereas bars 28 define a second group extending perpendicularly between the two bars 22, 24. It will be appreciated that the invention could be embodied in other truss constructions, wherein the transversely-extending or diagonal bars form other angles between the longitudinally-extending bars.

FIG. 5 illustrates the invention embodied in two-section trusses, wherein each truss is constructed of two sections, each including one of the longitudinally-extending bars and one-half of the transversely-extending bars. The two truss sections may be stored or shipped in nested relationship, as described above, in order to minimize their volume; and at the erection site, the transversely-extending bars may be secured together to form the truss structure.

Thus, the truss illustrated in FIG. 5 comprises a first truss section including one longitudinally-extending bar 32 and a plurality of transversely-extending bars grouped in pairs, 36*a*, 38*a*, each bar constituted of one-half of the complete length of the transversely-extending bars; whereas the second truss section includes the other longitudinally-extending bar 34 and the other half-section of the transversely-extending bars 36*b*, 38*b*. Each pair of bars 36*a*, 38*a* are joined to longitudinally-extending bar 32 at longitudinally-spaced points of bar 32 and occupy a common plane, which plane is displaced laterally from the plane containing bar 32. Similarly, bars 36*b*, 38*b* are joined to longitudinally-extending bar 34 at longitudinally-spaced points of bar 34, and occupy a common plane, which plane is displaced laterally from that of bar 34.

The two-section truss structure illustrated in FIG. 5 permits the two sections of a plurality of trusses to be stacked in nested relationship for shipping or storage, and then to be assembled at the erection site by securing bar sections 36*a* to bar sections 36*b*, and bar sections 38*a* to bar sections 38*b*. For this purpose, the tips of the latter bar sections may be provided with flanges 39 adapted to receive bolts, rivets or other fasteners, for securing the two sections together; alternatively, the sections may be welded together.

In the arrangement illustrated in FIG. 5, the transversely-extending bars define an apex at the points joined to their respective longitudinally-extending bar, and are second to the bars of the other truss section at the diverging ends of the transversely-extending bars. FIG. 6 illustrates another arrangement wherein the transversely-extending bars are joined at their diverging ends to their respective longitudinally-extending bars, and are secured at their apices to the bars of the other truss section. More particularly, the truss illustrated in FIG. 6 comprises a longitudinally-extended bar 42 and a plurality of transversely-extended bars 46 and 48 connected to bar 42 at longitudinally-spaced points thereof in a zig-zag fashion and occupy a common plane, which plane is displaced laterally from the plane containing longitudinally-extending bar 42.

Two 2-section trusses illustrated in FIG. 6 can be combined into one truss with cross-shaped diagonals as shown in FIG. 6*a* and FIG. 6*b*. For connecting the two trusses together, the apices of the transversely-extending bars may be provided with flanges 49 to receive bolts, rivets or other fasteners for securing the two trusses together. Alternatively the two trusses can be welded together.

As briefly described above, the invention also permits the trusses to be constructed as modular elements, to be shipped and stored in nesting relationship as described above, and to be secured together in any desired number at the erection site to provide the mechanical strength required for any particular application. This is more particularly illustrated in FIG. 7, showing three trusses each constructed as described above and assembled in nesting relationship as illustrated in FIGS. 3 and 3*a*, but secured together by a plurality of fasteners 51, 53, 55, 57, to produce a truss framework of the required mechanical strength for the particular application. In such a construction, it may be preferable to make the thicknesses (BL, BR, $BR_1$, and $BD_2$, of all four types of bars) equal, so that there would be no spaces between the longitudinally-extending bars.

It will be appreciated that the invention could be embodied in trusses of other designs, and of using various types of materials, including steel, aluminum, wood, plastic and concrete. It will also be appreciated that this invention could be embodied in toys or erection sets particularly since compactness for storage or shipment is usually of at least equal importance as mechanical strength. Many other variations, modifications and applications of the invention will be apparent.

What is claimed is:

1. A truss comprising a first, single longitudinally-extending bar extending along one side of the truss, a second, single longitudinally-extending bar extending along the opposite side of the truss, and a plurality of transversely-extending bars joined at longitudinally-spaced points to said first and second longitudinally-extending bars; characterized in that said transversely-extending bars are all joined to said first and second longitudinally-extending bars to occupy a first plane, said first longitudinally-extending bar being disposed in a second plane laterally of said first plane on one side of the transversely-extending bars, said second longitudinally-extending bar being disposed in a third plane laterally of said first plane on the other side of the transversely-extending bars; said transversely-extending bars being disposed in a repeating pattern with tapered spaces inbetween, such as to permit a plurality of such trusses to be nested together with the transversely-extending bars of all the trusses disposed in said first plane, and the longitudinally-extending bars of all the trusses disposed in said second and third planes, respectively.

2. The truss according to claim 1, wherein said transversely-extending bars include a first plurality of such bars joined at said longitudinally-spaced points to the longitudinally-extending bars to extend at a first angle thereto which is the same for all of said first plurality of bars, and a second plurality of such bars joined at said longitudinally-spaced points to the longitudinally-extending bars to extend at a second angle thereto which is the same for all of said second plurality of bars.

3. The truss according to claim 2, wherein said first and second angles are equal to each other with respect to a line passing through each of said longitudinally-spaced points perpendicular to said longitudinally-extending bars, but are on opposite sides of said lines.

4. The truss according to claim 2, wherein said first angle is an acute angle, and said second angle is 90°.

5. The truss according to claim 1, wherein said first and second longitudinally-extending bars are in parallel spaced relationship.

6. A plurality of trusses, each according to claim 1, all disposed in said nesting relationship with respect to each other to occupy a minimum volume for storage or transportation.

7. A structural member particularly useful for constructing a truss framework, comprising a longitudinally-extending bar, and a plurality of transversely-extending bars joined at longitudinally-spaced points to said longitudinally-extending bar; characterized in that said transversely-extending bars are all joined at one of their ends to said longitudinally-extending bar to occupy a first plane, which plane is laterally of a second plane containing said longitudinally-extending bar; the opposite ends of said transversely-extending bars being formed with attaching flanges for constructing a truss by attaching two such structural members together; said transversely-extending bars being disposed in a repeating pattern with tapered spaces inbetween, such as to permit a plurality of such structural members to be nested together with the transversely-extending bars of all the structural members disposed in said first plane, and the longitudinally-extending bars of all the structural members being disposed in said second plane.

8. The structural member according to claim 7, wherein said transversely-extending bars include a first plurality of such bars joined at said longitudinally-spaced points to the longitudinally-extending bar to extend at a first angle thereto which is the same for all of said first plurality of bars, and a second plurality of such bars joined at said longitudinally-spaced points to the longitudinally-extending bar to extend at a second angle thereto which is the same for all of said second plurality of bars.

9. The structural member according to claim 8, wherein said first and second angles are equal to each other with respect to a line passing through each of said longitudinally-spaced points perpendicular to said longitudinally-extending bar, but are on opposite sides of said line.

10. The structural member according to claim 8, wherein said first angle is an acute angle, and said second angle is 90°.

11. A truss comprising a pair of like structural members each according to claim 6 secured together by fasteners passing through the flanges at said opposite end of the transversely-extending bars with the longitudinally-extending bars of the two structural members occupying second and third planes on opposite sides of said first plane of said transversely-extending bars.

12. The truss according to claim 11, wherein the transversely-extending bars of each structural member are grouped in pairs each including two bars joined together at said one end defining an apex, and diverging at said opposite ends.

13. The truss according to claim 12, wherein the transversely-extending bars of each structural member are joined at their apices to their respective longitudinally-extending bar, and are secured at their diverging ends to the transversely-extending bars of the other structural member.

14. The truss according to claim 12, wherein the transversely-extending bars of each structural member are joined at their diverging ends to their respective longitudinally-extending bar, and are secured at their apices to the transversely-extending bars of the other structural member.

15. The truss according to claim 12, wherein the ends of the transversely-extending bars of each structural member, to be secured to the transversely-extending bars of the other structual member, are formed with attaching flanges.

16. A truss comprising a first longitudinally-extending bar;

a second longitudinally-extending bar parallel to but spaced from said first longitudinally- extending bar;

and a plurality of transversely-extending bars joined at longitudinally-spaced points to said first and second longitudinally-extending bars and occupying a first plane;

said first longitudinally-extending bar constituting the only longitudinally-extending bar on one side of the truss and being disposed in a second plane laterally spaced from said first plane on said one side of the truss;

said second longitudinally-extending bar constituting the only longitudinally-extending bar on the opposite side of the truss and being disposed in a second plane laterally spaced from said first plane on said opposite side of the truss;

said transversely-extending bars being disposed in a repeating pattern with tapered spaces inbetween, such as to permit a plurality of such trusses to be nested together with the transversely-extending bars of all the trusses disposed in said first plane, and the longitudinally-extending bars of all the trusses disposed in said second and third planes, respectively.

17. The truss according to claim 16, wherein said transversely-extending bars include a first plurality of such bars joined at said longitudinally-spaced points to each longitudinally-extending bar to extend at a first angle thereto which is the same for all of said first plurality of bars, and a second plurality of such bars joined at said longitudinally-spaced points to each longitudinally-extending bar to extend at a second angle thereto which is the same for all of said second plurality of bars.

18. The truss according to claim 17, wherein said first and second angles are equal to each other with respect to a line passing through each of said longitudinally-spaced points perpendicular to said longitudinally-extending bars, but are on opposite sides of said line.

19. The truss according to claim 17, wherein said first angle is an acute angle, and said second angle is 90°.

* * * * *